US010093119B2

(12) United States Patent
Nagase et al.

(10) Patent No.: US 10,093,119 B2
(45) Date of Patent: Oct. 9, 2018

(54) RECORDING MEDIUM

(71) Applicant: CANON KABUSHIKI KAISHA, Tokyo (JP)

(72) Inventors: Yoshiyuki Nagase, Kawasaki (JP); Masaya Asao, Yokohama (JP); Olivia Herlambang, Kawasaki (JP); Takeshi Ota, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/463,234

(22) Filed: Mar. 20, 2017

(65) Prior Publication Data

US 2017/0282630 A1 Oct. 5, 2017

(30) Foreign Application Priority Data

Mar. 31, 2016 (JP) ..... 2016-072000

(51) Int. Cl.
*B41M 5/50* (2006.01)
*B41M 5/52* (2006.01)

(52) U.S. Cl.
CPC ..... *B41M 5/52* (2013.01); *B41M 5/50* (2013.01); *B41M 5/5218* (2013.01); *B41M 5/5227* (2013.01); *B41M 5/5254* (2013.01); *B41M 5/5272* (2013.01); *B41M 5/5281* (2013.01)

(58) Field of Classification Search
CPC ..... B41M 5/50; B41M 5/5218; B41M 5/5227
See application file for complete search history.

(56) References Cited

U.S. PATENT DOCUMENTS 6,589,633 B1 * 7/2003 Ino ..... D06M 11/78 428/195.1
7,935,397 B2 5/2011 Okuda et al.
7,955,669 B2 6/2011 Nagase et al.
8,163,360 B2 4/2012 Asao et al.
8,247,042 B2 8/2012 Asakawa et al.
8,247,043 B2 8/2012 Tanaka et al.
8,252,392 B2 8/2012 Oguri et al.
8,252,393 B2 8/2012 Nagashima et al.
8,486,499 B2 7/2013 Nilo et al.
(Continued)

FOREIGN PATENT DOCUMENTS

EP 1 080 937 A1 3/2001
EP 1 700 708 A1 9/2006
(Continued)

OTHER PUBLICATIONS

Sep. 22, 2017 European Search Report in European Patent Appln. No. 17000485.7.

*Primary Examiner* — Betelhem Shewareged
(74) *Attorney, Agent, or Firm* — Fitzpatrick, Cella, Harper & Scinto

(57) ABSTRACT

A recording medium including a substrate and an ink-receiving layer. The ink-receiving layer contains an inorganic particle, a binder and at least one surfactant. The binder contains at least one resin selected from the group consisting of an acrylic resin, a polycarbonate-modified urethane resin and a polyether-modified urethane resin. The at least one surfactant comprises an acetylene-based surfactant. The contact angle of water to a surface of the ink-receiving layer at 60 seconds after contact of the water with the surface of the ink-receiving layer is 40 degrees or more to 80 degrees or less.

17 Claims, 1 Drawing Sheet

(56) References Cited

U.S. PATENT DOCUMENTS

| | | | | |
|---|---|---|---|---|
| 8,524,336 | B2 | 9/2013 | Oguri et al. | |
| 8,545,008 | B2 | 10/2013 | Asao et al. | |
| 8,609,209 | B2 | 12/2013 | Taguri et al. | |
| 8,795,798 | B2 | 8/2014 | Oguri et al. | |
| 8,846,166 | B2 | 9/2014 | Herlambang et al. | |
| 2002/0048658 | A1 | 4/2002 | Takahashi et al. | |
| 2003/0166742 | A1* | 9/2003 | Hirasa | C09D 11/324 523/160 |
| 2004/0170778 | A1 | 9/2004 | Tomita et al. | |
| 2004/0191433 | A1* | 9/2004 | Sakaguchi | B41M 5/52 428/32.34 |
| 2005/0196557 | A1* | 9/2005 | Ushiku | B41M 5/52 428/32.34 |
| 2005/0247235 | A1* | 11/2005 | Voeght | C09D 11/101 106/31.27 |
| 2009/0324857 | A1 | 12/2009 | Okuda et al. | |
| 2010/0112245 | A1 | 5/2010 | Nakano | |

FOREIGN PATENT DOCUMENTS

| | | | | | |
|---|---|---|---|---|---|
| JP | 2002-002090 | A | | 1/2002 | |
| JP | 2002-052812 | A | | 2/2002 | |
| JP | 2002-137537 | A | | 5/2002 | |
| JP | 2002127588 | A | * | 5/2002 | B41M 5/00 |
| JP | 2004-314454 | A | | 11/2004 | |
| WO | 2003/008198 | A1 | | 1/2003 | |
| WO | 2007/072996 | A1 | | 6/2007 | |

* cited by examiner

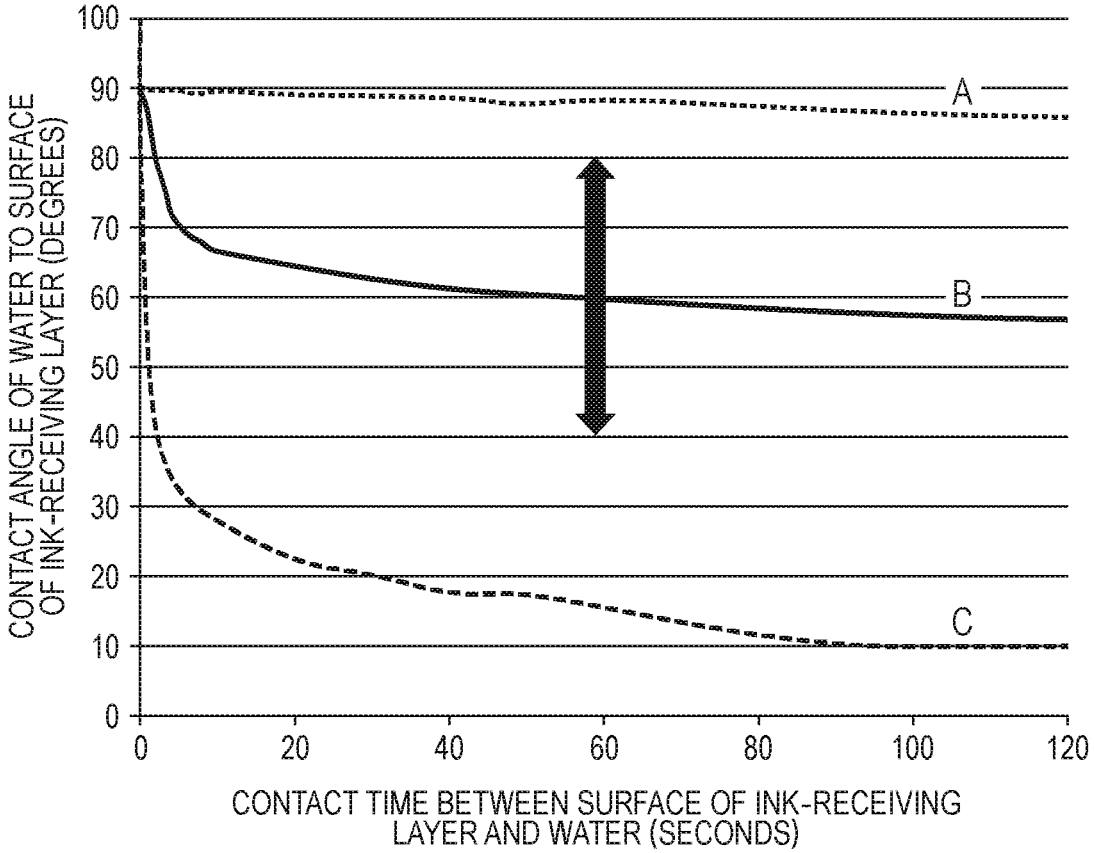
100
90
80
70
60
50
40
30
20
10
0
CONTACT ANGLE OF WATER TO SURFACE OF INK-RECEIVING LAYER (DEGREES)
A
B
C
0
20
40
60
80
100
120
CONTACT TIME BETWEEN SURFACE OF INK-RECEIVING LAYER AND WATER (SECONDS)

RECORDING MEDIUM

BACKGROUND OF THE INVENTION

Field of the Invention

The present invention relates to a recording medium.

Description of the Related Art

In recent years, a recorded article obtained by recording an image on a recording medium by means of an image recording method of an ink jet system may have been displayed outdoors in some cases. In a recording medium used for the formation of an image for being displayed outdoors, an ink-receiving layer thereof is required to have higher durability against water than a conventional recording medium while retaining ink absorbency comparable to that of the conventional recording medium.

Various investigations have heretofore been made for a technique for improving the durability against water and ink absorbency of the ink-receiving layer. Japanese Patent Application Laid-Open Nos. 2002-137537 and 2002-052812 describe an ink-receiving layer containing a porous inorganic pigment and a binder containing a water-insoluble resin to improve the durability against water. In addition, International Publication WO 2003/008198 describes an ink-receiving layer containing an organic particle with high water repellency to improve the durability against water. Further, Japanese Patent Application Laid-Open No. 2002-2090 describes providing an ink permeable layer containing a surfactant whose HLB value is 9 or less on an ink-receiving layer to improve the ink absorbency of the ink-receiving layer.

SUMMARY OF THE INVENTION

The present invention is intended to provide a recording medium having an ink-receiving layer sufficiently excellent in ink absorbency and durability.

The recording medium according to the present invention is a recording medium having a substrate and an ink-receiving layer, wherein the ink-receiving layer contains an inorganic particle, a binder and at least one surfactant, the binder contains at least one resin selected from the group consisting of an acrylic resin, a polycarbonate-modified urethane resin and a polyether-modified urethane resin, the at least one surfactant comprises an acetylene-based surfactant, and a contact angle of water to a surface of the ink-receiving layer at 60 seconds after contact of the water with the surface of the ink-receiving layer is 40 degrees or more to 80 degrees or less.

Further features of the present invention will become apparent from the following description of exemplary embodiments with reference to the attached drawing.

BRIEF DESCRIPTION OF THE DRAWING

FIGURE exemplarily illustrates the change over time of a contact angle of water to a surface of an ink-receiving layer for a recording medium according to the present invention and conventional recording media.

DESCRIPTION OF THE EMBODIMENTS

Preferred embodiments of the present invention will now be described in detail in accordance with the accompanying drawing.

According to an investigation by the present inventions, the recording medium described in Japanese Patent Application Laid-Open No. 2002-137537 can increase a contact angle of water just after water is dropped on the outermost surface by causing a water-insoluble resin to be contained in the outermost layer of an ink-receiving layer. However, the ink-receiving layer also contains a large amount of a water-soluble resin, so that the water-repellent effect thereof becomes insufficient, whereby water is absorbed in the ink-receiving layer. Therefore, such a recording medium is unsuitable for an outdoor use recording medium which is exposed to the rain. In the recording medium described in International Publication WO 2003/008198, the durability of an ink-receiving layer is improved by using an organic particle having high hydrophobicity in the ink-receiving layer. However, the ink absorbency thereof is poor compared with an ink-receiving layer containing an inorganic particle having a primary pore. In addition, the ink absorbency of an ink-receiving layer in the recording medium described in Japanese Patent Application Laid-Open No. 2002-2090 is improved. However, when a polyester resin is used as a binder for the ink-receiving layer, the durability of the ink-receiving layer cannot be sufficiently attained due to, for example, hydrolysis of the polyester resin. Further, even in the recording medium described in Japanese Patent Application Laid-Open No. 2002-052812, it is yet difficult to say that the improved durability and ink absorbency of an ink-receiving layer are sufficient.

The present inventors have carried out an extensive investigation with a view toward providing a recording medium having an ink-receiving layer sufficiently excellent in ink absorbency and durability. As a result, it has been found that a recording medium having a substrate and an ink-receiving layer, wherein the ink-receiving layer contains an inorganic particle, a binder and at least one surfactant, the binder contains at least one resin selected from the group consisting of an acrylic resin, a polycarbonate-modified urethane resin and a polyether-modified urethane resin, the at least one surfactant is an acetylene-based surfactant, and a contact angle of water to a surface of the ink-receiving layer at 60 seconds after contact of the water with the surface of the ink-receiving layer is 40 degrees or more to 80 degrees or less provides excellent ink absorbency and durability of the ink-receiving layer.

The present inventors presume the reason why the effect of the present invention is achieved by the above-described constituent features to be as follows. The contact angle of water to the surface of the ink-receiving layer at 60 seconds after contact of the water with the surface of the ink-receiving layer is set to 40 degrees or more, whereby a water-repellent effect is markedly improved to attain the excellent durability of the ink-receiving layer. Further, the ink-receiving layer contains at least one surfactant, the at least one surfactant has an acetylene-based surfactant, and the contact angle of water to the surface of the ink-receiving layer at 60 seconds after contact of the water with the surface of the ink-receiving layer is 80 degrees or less, whereby excellent ink absorbency is attained.

The surface tension of an aqueous ink used in ink jet recording is generally 40 mN/m or less which is lower than the surface tension of water, that is, 70 mN/m. Therefore, the contact angle of water to the surface of the ink-receiving layer at 60 seconds after contact of the water with the surface of the ink-receiving layer is set to 40 degrees or more to 80 degrees or less, whereby the surface of the ink-receiving layer exhibits a water repelling effect to improve the durability of the ink-receiving layer. On the other hand, the aqueous ink whose surface tension is lower than that of water permeates into the interior of the ink-receiving layer without being repelled on the surface of the ink-receiving layer, so that the ink absorbency is improved. Further, the binder contained in the ink-receiving layer contains at least one resin selected from the group consisting of an acrylic resin, a polycarbonate-modified urethane resin and a polyether-modified urethane resin, whereby an ink-receiving layer having excellent durability is obtained. Thus, by having the constituent features of the present invention, the effect of the present invention, that is, both of sufficiently excellent ink absorbency and durability of the ink-receiving layer can be achieved at a high level.

The present invention will hereinafter be described in detail by preferred embodiments.

Recording Medium:

The recording medium according to the present invention has a substrate and at least one ink-receiving layer. The recording medium of the present invention is favorably an ink jet recording medium used in an ink jet recording method, more favorably a recording medium for ink jet with an aqueous ink.

Surface Roughness of Recording Medium

The surface roughness of the recording medium may be suitably adjusted according to the degree of gloss required of the recording medium. Incidentally, as examples of a method for adjusting the surface roughness of the recording medium, there are mentioned a method in which a roll having specific irregularities is pressed against a surface of a substrate of a recording medium to provide irregularities, and a coating liquid for an ink-receiving layer is then applied on to this irregular surface and a method in which a coating liquid for an ink-receiving layer is applied to form an ink-receiving layer, and a roll having specific irregularities is then pressed against a surface of the ink-receiving layer to provide irregularities. In addition, the surface roughness may be controlled by the particle size of an inorganic particle contained in the ink-receiving layer or by further providing a layer containing an inorganic particle on the surface of the ink-receiving layer to control the surface roughness by the particle size of the inorganic particle in that layer or the coating rate of the layer. Favorable surface roughnesses of typical recording media will hereinafter be described.

(1) Glossy Paper

When the recording medium is glossy paper, the arithmetic average roughness Ra of the surface of the recording medium as defined by JIS B 0601:2001 is favorably 0.13 μm or less. Ra is more favorably 0.05 μm or more to 0.13 μm or less, particularly favorably 0.10 μm or more to 0.13 μm or less.

(2) Semi-Glossy Paper

When the recording medium is semi-glossy paper, the arithmetic average roughness Ra of the surface of the recording medium as defined by JIS B 0601:2001 is favorably 5.0 μm or less. Ra is more favorably 0.10 μm or more to 5.0 μm or less, particularly favorably 0.50 μm or more to 5.0 μm or less.

(3) Mat Paper

When the recording medium is mat paper, the arithmetic average roughness Ra of the surface of the recording medium as defined by JIS B 0601:2001 is favorably 1.0 μm or more to 10.0 μm or less, more favorably 1.0 μm or more to 5.0 μm or less. In addition, when the recording medium is mat paper, the root mean square slope RΔq of a roughness curve element of the surface of the recording medium as defined by JIS B 0601:2001 is favorably 0.3 μm or more, more favorably 0.5 μm or more.

The respective constituent features of the recording medium according to the present invention will hereinafter be described.

Substrate:

As the substrate, those already utilized for a recording medium or those usable for a recording medium and capable of functioning as a support of an ink-receiving layer may be utilized without limitation. As examples of the substrate, there are mentioned that composed of only base paper, that composed of only plastic film and that composed of only cloth. In addition, that provided with a plurality of layers may also be used as the substrate. Specifically, that having a paper base and a resin layer, that is, a resin-coated substrate, is mentioned. In the present invention, the resin-coated substrate, plastic film or cloth is favorably used as the substrate from the viewpoint of using the recording medium for the outdoor display.

In the present invention, the thickness of the substrate is favorably 50 μm or more to 400 μm or less, more favorably 70 μm or more to 200 μm or less. Incidentally, the thickness of the substrate in the present invention is calculated according to the following method. First, a section of the recording medium is cut out by a microtome, and that section is observed through a scanning electron microscope. The thickness of the substrate is then measured at arbitrary 100 or more points thereof, and the average value thereof is taken as the thickness of the substrate. Incidentally, the thicknesses of other layers in the present invention are also calculated according to the same method.

(1) Resin-Coated Substrate

Base Paper

The base paper is made by using wood pulp as a main raw material and adding synthetic pulp such as polypropylene and synthetic fiber such as nylon or polyester as needed. As examples of the wood pulp, there are mentioned Laubholz bleached kraft pulp (LBKP), Laubholz bleached sulfite pulp (LBSP), Nadelholz bleached kraft pulp (NBKP), Nadelholz bleached sulfite pulp (NBSP), Laubholz dissolving pulp (LDP), Nadelholz dissolving pulp (NDP), Laubholz unbleached kraft pulp (LUKP) and Nadelholz unbleached kraft pulp (NUKP). These may be used either singly or in any combination thereof. Among the wood pulps, LBKP, LBSP, NBSP, LDP or NDP which contains a large amount of short fiber components is favorably used. Chemical pulp (sulfate pulp or sulfite pulp) which contains little impurities is favorable as the pulp. In addition, pulp whose brightness is improved by conducting a bleaching treatment is also favorable. Incidentally, a sizing agent, a white pigment, a paper strengthening agent, a fluorescent whitening agent, a water retaining agent, a dispersant, a softening agent and/or the like may be suitably added into the base paper.

In the present invention, the thickness of the base paper is favorably 50 μm or more to 130 μm or less, more favorably 90 μm or more to 120 μm or less. Incidentally, the thickness of the base paper in the present invention is calculated according to the same method as in the thickness of the substrate.

The paper density of the base paper as defined by JIS P 8118 in the present invention is favorably 0.6 g/cm$^3$ or more to 1.2 g/cm$^3$ or less, more favorably 0.7 g/cm$^3$ or more to 1.2 g/cm$^3$ or less.

Resin Layer

The resin layer may be provided on only one surface or both surfaces of the base paper. In the present invention, the resin layer is favorably provided on both surfaces of the base paper. In addition, when the base paper is coated with a resin, the resin layer may be provided so as to coat a part of a surface of the base paper. The coating rate of the resin layer (an area of the surface of the base paper coated with the resin layer/the whole area of the surface of the base paper) is favorably 70% or more, more favorably 90% or more, particularly favorably 100%, that is, the whole surface of the base paper being coated with the resin layer.

In addition, the thickness of the resin layer in the present invention is favorably 20 μm or more to 60 μm or less, more favorably 35 μm or more to 50 μm or less. When the resin layer is provided on both surfaces of the base paper, the thicknesses of the resin layers on both surfaces favorably satisfy the above range, respectively.

The resin used in the resin layer is favorably a thermoplastic resin. As examples of the thermoplastic resin, there are mentioned an acrylic resin, an acrylic silicone resin, a polyolefin resin and a styrene-butadiene copolymer. Among these, the polyolefin resin is favorably used. Incidentally, the polyolefin resin in the present invention means a polymer obtained by using an olefin as a monomer. As specific examples of the polyolefin resin, there are mentioned homopolymers and copolymers of ethylene, propylene, isobutylene and the like. These may be used either singly or in any combination thereof. Among these, polyethylene is favorably used. Low density polyethylene (LDPE) or high density polyethylene (HDPE) is favorably used as the polyethylene.

In the present invention, the resin layer may contain a white pigment, a fluorescent whitening agent, a bluing agent such as ultramarine blue and/or the like for adjusting opacity, brightness and hue. Among these, the white pigment is favorably contained because the opacity can be improved. As examples of the white pigment, there are mentioned rutile-type and anatase-type titanium oxides. When the white pigment is used, the content of the white pigment in the resin layer is favorably 3 g/m$^2$ or more to 30 g/m$^2$ or less. Incidentally, when the resin layer is provided on both surfaces of the base paper, the total content of the white pigment in the resin layers on both surfaces favorably satisfies the above range. In addition, the content of the white pigment in the resin layer is favorably 25% by mass or less with respect to the content of the resin. If the content of the white pigment exceeds 25% by mass, the dispersion stability of the white pigment may not be sufficiently achieved in some cases.

The arithmetic average roughness Ra of the resin layer as defined by JIS B 0601:2001 in the present invention is favorably 0.12 μm or more to 0.18 μm or less, more favorably 0.13 μm or more to 0.15 μm or less. In addition, the average length RSm of a roughness curve element of the resin layer as defined by JIS B 0601:2001 in the present invention is favorably 0.01 mm or more to 0.20 mm or less, more favorably 0.04 mm or more to 0.15 mm or less.

(2) Plastic Film

In the present invention, a plastic means that containing, as a component, a polymer having a weight-average molecular weight of 10,000 or more at a proportion of 50% by mass or more, and a plastic film means that obtained by processing the plastic into a film form. The plastic used in the plastic film is a thermoplastic polymer. As specific examples of the thermoplastic polymer, there are mentioned a vinyl-based plastic, a polyester-based plastic, a cellulose ester-based plastic, a polyamide-based plastic and a heat-resistant engineering plastic.

As examples of the vinyl-based plastic, there are mentioned polyethylene, polyvinyl chloride, polyvinylidene chloride, polyvinyl alcohol, polystyrene, polypropylene and fluorine-containing resins. As examples of the polyester-based plastic, there are mentioned polycarbonate and polyethylene terephthalate. As examples of the cellulose ester-based plastic, there are mentioned cellulose diacetate, cellulose triacetate and cellulose acetate butyrate. As examples of the polyamide-based plastic, there are mentioned nylon 6, nylon 66 and nylon 12. As examples of the heat-resistant engineering plastic, there are mentioned polyimide, polysulfone, poly(ether sulfone), polyphenylene sulfide, poly(ether ether ketone) and polyether imide. These may be used either singly or in any combination thereof. Among these, polyvinyl chloride, polypropylene, polycarbonate or polyethylene terephthalate is favorably used in the present invention from the viewpoints of durability and cost.

In addition, synthetic paper obtained by subjecting the above-described plastic to such a treatment as a chemical treatment, surface coating or internal addition to improve the opacity thereof may also be used as the plastic film in the present invention. As the chemical treatment, there is mentioned a method in which the surfaces of the plastic film are dipped in an organic solvent such as acetone or methyl isobutyl ketone, thereby producing a swelled layer, and then the swelled layer is dried and solidified with another organic solvent such as methanol. As the surface coating, there is mentioned a method of forming a layer composed of a white pigment such as calcium carbonate or titanium oxide and a binder on a surface of the plastic. In addition, the internal addition includes a method of mixing a pigment such as calcium carbonate, titanium oxide, zinc oxide, white carbon, clay, talc or barium sulfate into the plastic as a filler. Further, a foamed plastic film whose opacity is improved by adding a polybutylene terephthalate fine particle, a polycarbonate fine particle, a polyester resin, a polycarbonate resin or the like to form voids in the plastic may also be used.

In the present invention, the thickness of the plastic film is favorably 50 μm or more to 300 μm or less, more favorably 75 μm or more to 135 μm or less.

The glass transition point (Tg) of the plastic used in the plastic film in the present invention is favorably −20° C. or more to 150° C. or less, more favorably −20° C. or more to 80° C. or less. Incidentally, the glass transition point in the present invention can be measured by, for example, the differential scanning calorimetry (DSC method).

The plastic density of the plastic film as defined by JIS K 7112:1999 in the present invention is favorably 0.6 g/cm$^3$ or more to 1.5 g/cm$^3$ or less, more favorably 0.7 g/cm$^3$ or more to 1.4 g/cm$^3$ or less.

The water absorption rate of the plastic film as defined by JIS K 7209:2000 in the present invention is favorably 5% or less, more favorably 1% or less.

In addition, when the plastic film is used, the adhesion between the ink-receiving layer and the plastic film can be improved by conducting a surface treatment by a surface oxidation treatment. As examples of the surface oxidation treatment, there are mentioned a corona discharge treatment, a flame treatment, a plasma treatment, a glow discharge treatment and an ozone treatment. These may be used either singly or in any combination thereof. Among these, the ozone treatment is favorable. The treatment rate of the ozone treatment is favorably 10 to 200 W·min/m$^2$, more favorably 50 to 150 W·min/m$^2$.

(3) Cloth

In the present invention, the cloth means that obtained by thinly and widely processing a large amount of fiber in the form of a plate. As the kinds of the fiber, there are mentioned natural fiber, recycled fiber recycled from a material having the nature of the natural fiber or from a plastic, and synthetic fiber obtained by using a polymer such as petroleum as a raw material. As examples of the natural fiber, there are mentioned cotton, silk, hemp, mohair, wool and cashmere. In addition, as examples of the recycled fiber, there are mentioned acetate, cupra, rayon and recycled polyester. Further, as examples of the synthetic fiber, there are mentioned nylon, polyester, acrylic, vinylon, polyethylene, polypropylene, polyamide and polyurethane.

Ink-Receiving Layer:

In the present invention, the ink-receiving layer may be a single layer or a multi-layer of two or more layers. In addition, the ink-receiving layer may be provided on only one surface or both surfaces of the substrate. The thickness of the ink-receiving layer on one surface of the substrate is favorably 15 μm or more to 60 μm or less, more favorably 25 μm or more to 50 μm or less, particularly favorably 30 μm or more to 45 μm or less.

In the present invention, the ink-receiving layer contains an inorganic particle, a binder and at least one surfactant. In addition, the binder contains at least one resin selected from the group consisting of an acrylic resin, a polycarbonate-modified urethane resin and a polyether-modified urethane resin, and the at least one surfactant is an acetylene-based surfactant. The respective materials which may be contained in the ink-receiving layer will hereinafter be described.

Inorganic Particle

In the present invention, the inorganic particle contained in the ink-receiving layer becomes a secondary particle composed of a large number of primary particles by aggregation among the primary particles. Further, the secondary particle is mutually bound by a binder, thereby forming the ink-receiving layer. However, there is a phenomenon that the binder is partially absorbed in a pore between the primary particles of the inorganic particle. If the amount of the binder absorbed in the pore between the primary particles of the inorganic particle increases, not only the binding force of the binder is lowered, but also the pore between the primary particles of the inorganic particle is filed with the binder, so that the ink absorbency of the ink-receiving layer is lowered. In particular, since at least one binder selected from the group consisting of an acrylic resin, a polycarbonate-modified urethane resin and a polyether-modified urethane resin is used in the present invention, the lowering of the ink absorbency is marked if the amount of the binder absorbed in the pore between the primary particles increases. In addition, the water-repellent effect brought by the binder is also lowered. Thus, the inorganic particle used in the ink-receiving layer favorably has the following constituent features for suppressing the absorption of the binder in between the primary particles of the inorganic particle.

In other words, regarding pores having a pore radius of 20 nm or less of the inorganic particle, the total pore volume of pores having a pore radius of 7 nm or more is favorably 25% by volume or less with respect to the total pore volume of all the pores having a pore radius of 20 nm or less from the viewpoints of the ink absorbency and durability of the ink-receiving layer. In addition, such a constituent feature corresponds to the case where regarding pores having a pore radius of 20 nm or less of the ink-receiving layer of the recording medium, the total pore volume of pores having a pore radius of 7 nm or more is 25% by volume or less with respect to the total pore volume of all the pores having a pore radius of 20 nm or less.

In general, that size of a pore between the primary particles of the inorganic particle (pore radius determined by pore distribution measurement) which is involved in the absorption of the at least one binder selected from the group consisting of an acrylic resin, a polycarbonate-modified urethane resin and a polyether-modified urethane resin is 7 nm or more. In other words, when the size of the pore between the primary particles of the inorganic particle is smaller than 7 nm, the binder is difficult to be absorbed because the pore is too small. Accordingly, the phenomenon that the binder is absorbed is suppressed as the proportion of the pores between those primary particles of the inorganic particle which are involved in the absorption of the binder, that is, the proportion of the pores having a pore radius of 7 nm or more, is smaller. However, if the pore radius as determined by pore distribution measurement is set to be 7 nm or more, a pore between the secondary particles (larger than the pore between the primary particles) is also involved. Therefore, the upper limit of the pore radius determined by pore distribution measurement is set to "20 nm" for the sake of convenience in such a manner that only the pores between the primary particles of the inorganic particle can be counted, exclusive of pores between the secondary particles which are not involved in the absorption of the binder. This upper limit "20 nm" is a numeral value which has been experimentally obtained as a result of an investigation by the present inventors about various inorganic particles. It has been confirmed that only pores between primary particles of a general inorganic particle can be counted by setting the upper limit to this value.

The proportion (% by volume) of pores having a pore radius of 7 nm or more to 20 nm or less is represented by [(Total pore volume of pores having a pore radius of 7 nm or more to 20 nm or less)/(Total pore volume of all the pores having a pore radius of 20 nm or less)]×100. As a result of an investigation about various recording media, it has been clarified that the proportion of the pores having a pore radius of 7 nm or more to 20 nm or less is 25% by volume or less, whereby the ink absorbency and durability of the ink-receiving layer can be more improved.

Incidentally, the fact that when the proportion of the pores having a pore radius of 7 nm or more to 20 nm or less in the inorganic particle is 25% by volume or less, the proportion of pores having a pore radius of 7 nm or more to 20 nm or less in the ink-receiving layer of the recording medium becomes 25% by volume or less has been verified by separately conducting an experiment.

In addition, in the present invention, the oil absorption of the inorganic particle is favorably 150 ml/100 g or more to 240 ml/100 g or less from the viewpoints of the ink absorbency and durability of the ink-receiving layer. As a result of an investigation by the present inventors, it has been found that the amount of the at least one binder selected from the group consisting of an acrylic resin, a polycarbonate-modified urethane resin and a polyether-modified urethane resin which is absorbed by the inorganic particle greatly depends on the oil absorption of the inorganic particle, and the oil absorption of the inorganic particle correlates with the durability of the ink-receiving layer. In other words, the oil absorption of the inorganic particle is 240 ml/100 g or less, whereby the binder is difficult to be absorbed by the inorganic particle, and so the function as the binder can be sufficiently retained. Incidentally, the oil absorption in the present invention is measured according to "Refined linseed oil method" defined in JIS K 5101-13-1.

In addition, the BET specific surface area of the inorganic particle is favorably 380 $m^2/g$ or more. When the BET specific surface area of the inorganic particle is 380 $m^2/g$ or more, the contact area between the binder and the inorganic particle becomes large, so that the interaction between them is more increased, whereby the durability of the ink-receiving layer can be more improved. Incidentally, the BET specific surface area in the present invention is a specific surface area determined by the BET method. The BET method is a method in which molecules or ions whose size has been known are adsorbed on the surface of a sample to measure the specific surface area of the sample from the adsorbed amount thereof. In the present invention, nitrogen gas is used as a gas adsorbed on the sample.

In the present invention, the oil absorption and BET specific surface area of the inorganic particle contained in the ink-receiving layer can be measured in the following manner. First, a part of the ink-receiving layer is scraped followed by heating for 2 hours at a temperature of 600° C. At that time, the residue obtained by the heating can be regarded as the inorganic particle contained in the ink-receiving layer. Accordingly, the oil absorption and BET specific surface area of the residue are measured, whereby the oil absorption and BET specific surface area of the inorganic particle are determined.

In addition, in the present invention, the total pore volume of pores having a pore radius of 2 nm or more to 10 nm or less in the ink-receiving layer of the recording medium is favorably 0.2 ml/g or more. In order to satisfy such a constituent feature, the total pore volume of pores having a pore radius of 2 nm or more to 10 nm or less in the inorganic particle is favorably 0.4 ml/g or more.

In the present invention, the inorganic particle may also be used in a coating liquid for an ink-receiving layer in a state of being dispersed by a dispersant. In this case, the average secondary particle size of the inorganic particle in the dispersed state is favorably 1 μm or more to 20 μm or less, more favorably 3 μm or more to 9 μm or less. Incidentally, the average secondary particle size of the inorganic particle in the dispersed state is a volume average secondary particle size measured by a laser diffraction method.

In the present invention, the content of the inorganic particle in the ink-receiving layer is favorably 40% by mass or more to 90% by mass or less, more favorably 50% by mass or more to 80% by mass or less.

As examples of the inorganic particle used in the present invention, there are mentioned alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, calcium carbonate, zirconium oxide and zirconium hydroxide. These inorganic particles may be used either singly or in any combination thereof. Among the inorganic particles, silica is favorably used from the viewpoint of being able to form a porous structure with high ink absorbency.

The production process for the silica used in the ink-receiving layer is roughly divided into a wet process and a dry process (gas-phase process) according to a production process thereof. As the wet process, there is known a process in which active silica is produced by acid decomposition of a silicate, this resulting silica is moderately polymerized followed by aggregation and precipitation to obtain hydrous silica. On the other hand, as for the dry process (gas-phase process), there are known a process using high-temperature gas phase hydrolysis of a silicon halide (flame hydrolysis process) and a process of obtaining anhydrous silica by a process in which silica sand and coke are heated, reduced and gasified by an arc in an electric furnace, and then the resultant product is oxidized with air (arc process). In the present invention, the silica obtained by the wet process (hereinafter also referred to as "wet-process silica") is favorably used from the viewpoint of improving both ink absorbency and durability of the ink-receiving layer. As examples of the wet-process silica, there are mentioned precipitated silica and gel-process silica.

As an example of a production process for the gel-process silica, there may be mentioned the following process. First, silica hydrosol is gelled which is produced by causing a silicate to react with an inorganic acid in such a manner that the concentration of $SiO_2$ is 10 to 20% by mass. Incidentally, as examples of the silicate, there are mentioned sodium silicate, potassium silicate and ammonium silicate. However, sodium silicate is often industrially used. In addition, as examples of the inorganic acid, there are mentioned sulfuric acid, nitric acid and hydrochloric acid. However, sulfuric acid is generally used.

The silica hydrogel obtained by the above process is then washed with water, thereby removing inorganic acid salts contained in the silica hydrogel. Thereafter, the resultant silica hydrogel is subjected to a hydrothermal treatment. At this time, the average pore radius and oil absorption of the silica hydrogel can be controlled depending on the setting of the pH and temperature of water used in the hydrothermal treatment and the treatment time. For example, when the hydrothermal treatment is conducted for the silica hydrogel by using water of a pH of 2 to 10 and a temperature of 20 to 100° C., the average pore radius and oil absorption are increased. Incidentally, the hydrothermal treatment is favorably conducted at a pH of 2 to 8 and a temperature of 40 to 90° C. taking the balance of physical properties of the silica gel into consideration.

This silica hydrogel is then ground and granulated by means of a ball mill or the like so as to give a silica particle having an average secondary particle size of several micrometers, and the resultant particle is dried for 1 to 100 seconds at a temperature of 100 to 1,000° C., thereby obtaining the gel-process silica.

Binder

In the present invention, a binder means a material capable of binding the inorganic particle to form a film. In the present invention, the binder contains at least one resin selected from the group consisting of an acrylic resin, a polycarbonate-modified urethane resin and a polyether-modified urethane resin. In the present invention, the acrylic resin, the polycarbonate-modified urethane resin and the polyether-modified urethane resin are favorably used in a state of a resin particle (state of an emulsion) in a coating liquid for an ink-receiving layer.

In the present invention, the content of the binder in the ink-receiving layer is favorably 100 parts by mass or less, more favorably 70 parts by mass or less, with respect to 100 parts by mass of the inorganic particle from the viewpoint of the ink absorbency. In addition, the content of the binder is favorably 30 parts by mass of more, more favorably 50 parts by mass or more from the viewpoint of the binding ability of the ink-receiving layer. In other words, the content of the binder is favorably 30 parts by mass or more to 100 parts by mass or less, more favorably 50 parts by mass or more to 70 parts by mass or less with respect to 100 parts by mass of the inorganic particle.

In the present invention, the glass transition points of the acrylic resin, the polycarbonate-modified urethane resin and the polyether-modified urethane resin are favorably 20° C. or less. The glass transition point of the resin is 20° C. or less, whereby binding force between the resin and the inorganic particle can strengthen to more improve the durability.

In addition, in the present invention, the resin selected from the group consisting of the acrylic resin, the polycarbonate-modified urethane resin and the polyether-modified urethane resin is favorably a cationic resin from the viewpoint of the color developing property of the resulting image. In addition, the resin is favorably a nonionic resin from the viewpoint of the coating stability of the coating liquid for the ink-receiving layer.

Further, in the present invention, it is favorable from the viewpoint of the durability of the ink-receiving layer that (1) the ink-receiving layer does not contain a water-soluble resin, or that (2) when the ink-receiving layer contains the water-soluble resin, the content of the water-soluble resin in the binder in the ink-receiving layer is 20% by mass or less. In other words, the content of the water-soluble resin in the binder in the ink-receiving layer is more favorably 0% by mass or more to 20% by mass or less. The content of the water-soluble resin is more favorably 0% by mass or more to 15% by mass or less, particularly favorably 0% by mass or more to 10% by mass or less. As examples of the water-soluble resin, there are mentioned polyvinyl alcohol and polyvinyl alcohol derivatives.

The respective resins contained in the ink-receiving layer will hereinafter be described.

(1) Acrylic Resin

In the present invention, the acrylic resin means a polymer of a (meth)acrylic acid ester. The acrylic resin may be a homopolymer or a copolymer with another monomer so long as the (meth)acrylic acid ester is used as a monomer. Incidentally, "(meth)acrylic acid" means acrylic acid or methacrylic acid.

As examples of the acrylic acid ester, there are mentioned methyl acrylate, ethyl acrylate, butyl acrylate, 2-ethylhexyl acrylate, 2-dimethylaminoethyl acrylate, 2-hydroxyethyl acrylate, 2-hydroxypropyl acrylate, 2-hydroxybutyl acrylate, isobutyl acrylate, octyl acrylate, lauryl acrylate and stearyl acrylate. In addition, as examples of the methacrylic acid ester, there are mentioned methyl methacrylate, ethyl methacrylate, butyl methacrylate, 2-ethylhexyl methacrylate, 2-dimethylaminoethyl methacrylate, 2-hydroxyethyl methacrylate, 2-hydroxypropyl methacrylate, 2-hydroxybutyl methacrylate, isobutyl methacrylate, octyl methacrylate, lauryl methacrylate and stearyl methacrylate. As another monomer capable of copolymerizing with the (meth)acrylic acid ester, there is mentioned a vinyl monomer. As specific example of the vinyl monomer, there are mentioned styrene; styrene derivatives such as vinyltoluene, vinylbenzoic acid, α-methylstyrene, p-hydroxymethylstyrene and styrenesulfonic acid; and vinyl ethers such as methyl vinyl ether, butyl vinyl ether, methoxyethyl vinyl ether, N-vinylpyrrolidone, 2-vinyloxazone and vinylsulfonic acid, and derivatives thereof.

In the present invention, the acrylic resin is favorably a polyacrylic acid ester, a polymethacrylic acid ester or a copolymer of an acrylic acid ester and a methacrylic acid ester. Among others, a copolymer of a methacrylic acid ester having a relatively high glass transition point and an acrylic acid ester having a relatively low glass transition point is more favorable because the glass transition point of the finally obtained acrylic resin can be controlled by the copolymerization ratio thereof.

(2) Urethane Resin (Polycarbonate-Modified Urethane Resin or Polyether-Modified Urethane Resin)

The urethane resin in the present invention means a resin having a urethane linkage. When the binder contains at least one urethane resin in the present invention, this urethane resin is at least one selected from the group consisting of a polycarbonate-modified urethane resin and a polyether-modified urethane resin. Hereinafter, the polycarbonate-modified urethane resin and the polyether-modified urethane resin are also collectively referred to simply as "urethane resin".

The urethane resin is favorably a compound obtained by reacting a polyisocyanate, a polyol and a chain extender. Specifically, as examples of the polyisocyanate, there are mentioned aromatic isocyanates such as tolylene diisocyanate, diphenylmethane diisocyanate, polymeric diphenylmethane diisocyanate, tolidine diisocyanate, naphthalene diisocyanate, xylylene diisocyanate and tetramethylxylylene diisocyanate; aliphatic isocyanates such as hexamethylene diisocyanate and trimethyl-hexamethylene diisocyanate; and alicyclic isocyanates such as isophorone diisocyanate, cyclohexane-1,3-diisocyanate and cyclohexane-1,4-diisocyanate. These may be used either singly or in any combination thereof.

A polyether-based polyol such as polypropylene glycol, polyethylene glycol or polytetramethylene glycol is used as the polyol, thereby obtaining the polyether-modified urethane resin. In addition, a polycarbonate-based polyol such as polyhexamethylene carbonate is used as the polyol, thereby obtaining the polycarbonate-modified urethane resin. These polyols may be used either singly or in any combination thereof.

A low molecular weight glycol such as ethylene glycol, a low molecular weight diamine or a compound containing an active hydrogen atom, such as a low molecular weight aminoalcohol may be used as the chain extender. These may be used either singly or in any combination thereof.

Surfactant

In the present invention, the ink-receiving layer contains at least one surfactant. In addition, the at least one surfactant is an acetylene-based surfactant. Incidentally, the acetylene-based surfactant in the present invention means a surfactant having an acetylene structure in its molecule. As examples of the acetylene-based surfactant, there are mentioned acetylene alcohols such as acetylene glycol, acetylene monools, acetylene diols and ethoxylate acetylene diol. These may be used either singly or in any combination thereof.

The ink-receiving layer may also contain one or more other surfactants, as needed, in addition to the acetylene-based surfactant. As the other surfactants, surfactants such as a fluorine-based surfactant, a silicone-based surfactant, a polyether-modified silicone-based surfactant, a polysiloxane-based surfactant and an ether-modified polysiloxane-based surfactant may be used.

In addition, the HLB value of the acetylene-based surfactant is favorably 10 or less from the viewpoint of the durability of the ink-receiving layer. Incidentally, the HLB value in the present invention is a value determined by the Griffin's equation represented by the following equation:

$$HLB \text{ value} = (\text{Molecular weight of hydrophilic group} / \text{Molecular weight of whole surfactant}) \times 20.$$

Mildewproofing Agent

The ink-receiving layer of the recording medium according to the present invention favorably contains a mildew proofing agent for inhibiting the growth of mildew due to the influence of rainwater or the like in the case where the recording medium is displayed outdoors.

In addition, the solubility of the mildew proofing agent in water is favorably 1% by mass or less. The solubility of the mildew proofing agent in water is 1% by mass or less, whereby the outflow of the mildew proofing agent from the ink-receiving layer due to dissolution of the mildew proofing agent into water having permeated into the ink-receiving layer can be inhibited to inhibit the lowering of the mildew proofing ability. Incidentally, the solubility of the mildew proofing agent in water is a value measured at 25° C.

In addition, the content of the mildew proofing agent in the ink-receiving layer is 0.05% by mass or more to 3% by mass or less with respect to the whole mass of the ink-receiving layer.

In addition, the average particle size of the mildew proofing agent is favorably 0.1 μm or more to 20 μm or less. The average particle size of the mildew proofing agent falls within the above range, whereby both outflow of the mildew proofing agent caused by water having permeated into the ink-receiving layer and lowering of haze of the ink-receiving layer caused by the mildew proofing agent can be inhibited at a higher level. Incidentally, the average particle size of the mildew proofing agent is an average particle size value in a volume basis particle size distribution determined by measurement with a laser diffraction/scanning type particle size distribution measuring apparatus (Model: LS 13 320) manufactured by BECKMAN COULTER CO.

The mildew proofing agent used in the present invention is favorably at least one compound selected from the group consisting of a triazole compound, a pyrithione compound, a pyridine compound, a benzimidazole compound, a benzthiazole compound, a cyanobromine compound, a carbamic acid compound, an imidazole compound and a thiabendazole compound. A small amount of these compounds is added, thereby achieving the mildew proofing effect.

As specific examples of the triazole compound, there are mentioned α-butyl-α-(2,4-dichlorophenyl)-1H-1,2,4-triazole-1-ethanol (common name: hexaconazole), α-[2-(4-chlorophenyl)ethyl]-α-(1,1-dimethylethyl)-1H-1,2,4-triazole-1-ethanol (common name: tebuconazole), α-(4-chlorophenyl)-α-(1-cycloprpylethyl)-1H-1,2,4-triazole-1-ethanol (common name: cyproconazole) and 1-[[2-(2,4-chlorophenyl)-α-(4-n-propyl-1,3-dioxolan-2-yl]methyl]-1H-1,2,4-triazole (common name: propiconazole). As examples of the pyridine compound, there are mentioned a sodium omadine compound and 2,2'-dithiobis.

As specific examples of the benzimidazole compound, there are mentioned methyl-2-benzimidazole carbamate (common name: carbendazim), ethyl-2-benzimidazole carbamate and 2-(4-thiazolyl) benzimidazole.

Other Additives

In the present invention, the ink-receiving layer may also contain other additives than the above-described components. As specific examples of the other additives, there are mentioned a crosslinking agent, a pH adjuster, a thickener, a flowability modifier, an antifoaming agent, a foam suppressor, a parting agent, a penetrant, a coloring pigment, a coloring dye, a fluorescent whitening agent, an ultraviolet absorbent, an antioxidant, an antiseptic, a mildew proofing agent, a water-proofing agent, an ink fixing agent, a curing agent and a weathering material.

As examples of the crosslinking agent, there are mentioned an aldehyde compound, a melamine compound, an isocyanate compound, a zirconium compound, a titanium compound, an amide compound, an aluminum compound, boric acid, a borate, a carbodiimide compound and an oxazoline compound. In addition, another cationic resin than the above-described acrylic resin and urethane resin or a polyvalent metal salt is favorably contained as an ink fixing agent. As examples of the cationic resin, there are mentioned a polyethylene imine resin, a polyamine resin, a polyamide resin, a polyamide epichlorohydrin resin, a polyamine epichlorohydrin resin, a polyamide polyamine epichlorohydrin resin, a polydiallylamine resin and a dicyane diamide condensate. As examples of the polyvalent metal salt, there are mentioned a calcium compound, a magnesium compound, a zirconium compound, a titanium compound and an aluminum compound. Among these, the calcium compound is favorable, and calcium nitrate tetrahydrate is more favorable.

Contact Angle of Water to Surface of Ink-Receiving Layer

In the present invention, the ink-receiving layer has such a feature that a contact angle of water to a surface of the ink-receiving layer at 60 seconds after contact of the water with the surface of the ink-receiving layer is 40 degrees or more to 80 degrees or less. The measurement of the contact angle can be made by means of DAT (Dynamic Absorption Tester, product name: 1100DAT, manufactured by FIBRO Co.) or the like. Specifically, 4 μl of pure water is dropped on the surface of the ink-receiving layer, and the condition after the dropping is observed by video camera recording. After a lapse of a necessary time period, the contact angle of a droplet (water) to the surface of the ink-receiving layer is measured from a video image.

FIGURE exemplarily illustrates the change over time of a contact angle of water to a surface of an ink-receiving layer from the beginning of the contact of water with the surface of the ink-receiving layer until 120 seconds thereafter on the recording medium (B) according to the present invention and conventional recording media (A and C). In the drawing, in the recording medium according to the present invention, the contact angle of water to the surface of the ink-receiving layer 60 seconds later is 40 degrees or more to 80 degrees or less as illustrated by B. Therefore, both of excellent ink absorbency and durability can be attained for the ink-receiving layer. On the other hand, in a conventional recording medium whose ink-receiving layer does not contain a surfactant as in Comparative Example 1 described later, for example, the contact angle of water to the surface of the ink-receiving layer 60 seconds later exceeds 80 degrees as illustrated by "A", and so the ink absorbency is insufficient. In addition, in a conventional recording medium in which the contact angle of water to the surface of the ink-receiving layer 60 seconds later is less than 40 seconds as illustrated by "C", the durability of the ink-receiving layer is insufficient.

Incidentally, the contact angle of water to the surface of the ink-receiving layer at 60 seconds after contact of the water with the surface of the ink-receiving layer is set to be 40 degrees or more to 80 degrees or less in the present invention from the viewpoint of verifiability. This means that the contact angle is almost stabilized 60 seconds after contact of the water. The contact angle is favorably stabilized 40 seconds later, more favorably 20 seconds later, particularly favorably 10 seconds later.

Production Process for Recording Medium:

In the present invention, no particular limitation is imposed on the production process for the recording medium. However, a process having a step of preparing a coating liquid for an ink-receiving layer and a step of applying the coating liquid to a substrate is favorable. The production process for the recording medium will hereinafter be described.

In the present invention, as an example of a process for forming the ink-receiving layer on the substrate, there may be mentioned the following process. First, the coating liquid for the ink-receiving layer is prepared. This coating liquid is then applied to the substrate and dried, whereby the recording medium according to the present invention can be obtained. The coating weight of the coating liquid is favorably 5 g/m$^2$ or more to 40 g/m$^2$ or less. The coating weight of the coating liquid falls within the above range, whereby both improvement in ink absorbency and improvement in coating stability of the coating liquid can be attained.

As a coating method of the coating liquid, a roll coater, a blade coater, a bar coater, an air knife coater, a gravure coater, a reverse coater, a transfer coater, a die coater, a kiss coater, a rod coater, a curtain coater, a coater using an extrusion system or a coater using a slide hopper system may be used. Incidentally, the coating liquid may also be heated upon the application thereof.

In addition, a surface treating liquid containing a surface treating agent may also be applied to a surface of the substrate to which the coating liquid is applied prior to the application of the coating liquid for the ink-receiving layer. Thus, the wettability of the substrate for the coating liquid can be improved to improve adhesion between the ink-receiving layer and the substrate. In this case, as examples of the surface treating agent, there are mentioned thermoplastic resins such as an acrylic resin, a polyurethane resin, a polyester resin, a polyethylene resin, a polyvinyl chloride resin, a polypropylene resin, a polyamide resin and a styrene-butadiene copolymer, and a silane coupling agent. These may be used either singly or in any combination thereof. In addition, an inorganic particle may also be contained in the surface treating liquid in such a range as not to impair the effect of the present invention. Those mentioned above may be used as the inorganic particle.

In addition, as drying methods after the application, there are mentioned a method of using a hot air dryer such as a linear tunnel dryer, an arch dryer, an air loop dryer or a sine curve air float dryer and a method of using a dryer utilizing infrared rays, heating dryers or microwaves. The heating temperature upon the drying of the coating liquid may be set to, for example, 80 to 130° C.

According to an embodiment of the present invention, there can be provided a recording medium having an ink-receiving layer sufficiently excellent in ink absorbency and durability.

EXAMPLES

The present invention will hereinafter be described in more detail by Examples and Comparative Examples. The present invention is not limited by the following Examples at all unless going beyond the gist thereof.

Preparation of Substrate

NEW YUPO (trademark) FGS110 (product name, product of Yupo Corporation, thickness: 110 μm) which was propylene synthetic paper was provided as a substrate.

Preparation of Inorganic Particle Dispersion Liquids I to III

After inorganic particles (all, wet-process silica) described in Table 1 were respectively added into pure water, stirring by a mixer was conducted for 30 minutes to prepare the inorganic particle dispersion liquids I to III the respective solid contents of which were 15.0% by mass.

In addition, the oil absorption (ml/100 g) of each of the inorganic particles used in the respective inorganic particle dispersion liquids was measured by the refined linseed oil method. Further, the BET specific surface area (m$^2$/g) and pore distribution of the inorganic particle were measured by a nitrogen adsorption method using an automatic specific surface area and pore distribution measuring apparatus Tristar-3000 (manufactured by Shimadzu Corporation). Regarding pores having a pore radius of 20 nm or less of the inorganic particle, the proportion (% by volume) of pores having a pore radius of 7 nm or more to 20 nm or less (described as "Proportion of pore volume" in Table 1) was calculated from the pore distribution thus obtained according to [(Total pore volume of pores having a pore radius of 7 nm or more to 20 nm or less)/(Total pore volume of all the pores having a pore radius of 20 nm or less)]×100. The results are shown in Table 1.

TABLE 1

| Inorganic Particle Dispersion Liquid | Inorganic particle (silica) Product name | Oil absorption (ml/100 g) | BET specific surface area (m$^2$/g) | Proportion of pore volume (% by volume) |
|---|---|---|---|---|
| I | SYLYSIA 660 (product of Fuji Sylisia Chemical Ltd.) | 220 | 600 | 14.9 |
| II | NIPGEL E-75 (product of Tosoh Silica Corporation) | 120 | 45 | 79.6 |
| III | NIPGEL AY-603 (product of Tosoh Silica Corporation) | 260 | 300 | 59.7 |

Preparation of Coating Liquids A to S for Ink-Receiving Layer

The inorganic particle dispersion liquids I to III, binders and surfactants were respectively mixed as shown in Table 2 so that inorganic particle/binder/surfactant=60/35/1.2 in terms of mass ratio of the dry solid contents to prepare the coating liquids A to S each having a solid content of 20% by mass.

Incidentally, the binder used in the coating liquid I was prepared in such a manner that the mass ratio of the polyvinyl alcohol (PVA235) to the acrylic resin (Mowinyl 7720) was 18/82 in terms of dry solid content. In addition, the binder used in the coating liquid J was prepared in such a manner that the mass ratio of the polyvinyl alcohol (PVA235) to the acrylic resin (Mowinyl 7720) was 24/76 in terms of dry solid content. In addition, the coating liquid K was prepared by further adding a polyether-modified silicone surfactant (mass ratio 0.4 in terms of dry solid content) into the acetylene-based surfactant (mass ratio 1.2 in terms of dry solid content) as a surfactant.

In addition, the binder used in the coating liquid Q was prepared in such a manner that the mass ratio of the polyvinyl alcohol (PVA235) to the acrylic resin (Mowinyl 7720) was 34/66 in terms of dry solid content. Incidentally, the product names and manufacturers of products of the binders B1 to B7 and surfactants C1 to C6 are as follows.

Binder

B1: polycarbonate-modified urethane resin (product name: Hydran WLS210, DIC Corporation, Tg: −15° C.)

B2: polyether-modified urethane resin (product name: Hydran WLS201, DIC Corporation, Tg: −50° C.)

B3: cationic acrylic resin (product name: Mowinyl 7820, The Nippon Synthetic Chemical Industry Co., Ltd., Tg: 4° C.)

B4: nonionic acrylic resin (product name: Mowinyl 7720, The Nippon Synthetic Chemical Industry Co., Ltd., Tg: 4° C.)

B5: anionic acrylic resin (product name: Bonron T-733, Mitsui Chemicals, Inc., Tg: 23° C.)

B6: polyvinyl alcohol (product name: PVA235, Kuraray Co., Ltd.)

B7: polyester (product name: Elitel KT-9204, UNITIKA LTD., Tg: 19° C.)

Surfactant

C1: acetylene glycol (product name: Olfine E1004, HLB: 9, Nisshin Chemical Industry Co., Ltd.)

C2: acetylene glycol (product name: Surfinol 420, HLB: 4, Nisshin Chemical Industry Co., Ltd.)

C3: acetylene glycol (product name: Surfinol 440, HLB: 8, Nisshin Chemical Industry Co., Ltd.)

C4: acetylene glycol (product name: Surfinol 465, HLB: 13, Nisshin Chemical Industry Co., Ltd.)

C5: polyether-modified silicone (product name: FZ2104, HLB: 9, Dow Corning Toray Co., Ltd.)

C6: acetylene alcohol (product name: Surfinol 61, HLB: 6, Nisshin Chemical Industry Co., Ltd.).

Incidentally, since all of these surfactants are surfactants having a dry solid content of 100% by mass, that is, the effective component content thereof being 100% by mass, calculation was made with "mass of surfactant=mass of dry solid content".

Preparation of Recording Medium

Example 1

The above-described coating liquid A was applied on to the substrate so as to give a dry coating weight of 25 g/m$^2$ and dried with hot air of 115° C. to form an ink-receiving layer, thereby obtaining a recording medium according to Example 1. Regarding the recording medium thus obtained, the contact angle of water to a surface of the ink-receiving layer at 60 seconds after contact of the water with the surface of the ink-receiving layer was measured by means of the 1100DAT of FIBRO Co. The result is shown in Table 2.

Examples 2 to 14 and Comparative Examples 1 to 5

Recording media according to Examples 2 to 14 and Comparative Examples 1 to 5 were produced in the same manner as in Example 1 except that the coating liquid was changed as shown in Table 2, and the contact angle of water to a surface of the ink-receiving layer at 60 seconds after contact of the water with the surface of the ink-receiving layer was measured in the same manner as in Example 1. The results are shown in Table 2.

Evaluation of Recording Medium:

Regarding the recording media obtained in Examples 1 to and Comparative Examples 1 to 5, ink absorbency and durability of each ink-receiving layer were evaluated according to the following respective methods. The evaluated results are shown in Table 2. Incidentally, in the following evaluation criteria of the respective evaluations, A and B were taken as favorable levels, and C was taken as an unacceptable level in the present invention.

Ink Absorbency

A solid image of 120% duty was recorded on each of the recording media with a cyan ink by means of an ink jet recording apparatus, and the degree of absorption of the ink just after the recording was visually observed. Using imagePROGRAF iPF6400 (product name, manufactured by Canon Inc.) as the ink jet recording apparatus with an ink tank PFI-106 (product name, manufactured by Canon Inc.) installed thereto to conduct the recording. The recording conditions were set to temperature 23° C. and relative humidity 50%. Incidentally, in the ink jet recording apparatus, an image recorded under conditions in which an ink droplet of about 4.5 ng is applied to a unit region of 1/1,200 in.×1/1,200 in. at a resolution of 1,200 dpi×1,200 dpi is defined as the recording duty being 100%. The evaluation criterion is as follows:

A: The ink was absorbed within 2 seconds after the printing;

B: The ink was absorbed within 5 seconds but over 2 seconds after the printing;

B$^-$: The ink was absorbed within 8 seconds but over 5 seconds after the printing;

C: The ink was not absorbed even over 8 seconds after the printing.

Durability of Ink-Receiving Layer

Each of the recording media was exposed for 200 hours by means of the outdoor accelerated weathering test method conforming to ISO 18930 to conduct a durability test. The film strength of the ink-receiving layer after this durability test was measured, thereby evaluating the durability of the ink-receiving layer. The measurement of the film strength of the ink-receiving layer was conducted in the following manner. A black paper sheet (product name: New Color R, product of Lintec Corporation) was pressed against a surface of the ink-receiving layer of the recording medium after the durability test with a load of 75 g/cm$^2$ and was bidirectionally scanned 20 times by means of a JSPS-type rubbing color fastness testing machine (product name: AB-301 COLOR FASTNESS RUBBING TESTER, manufactured by TESTER SANGYO CO., LTD). The optical density (OD) of a portion of the black paper which came into no contact with the surface of the ink-receiving layer and that of a portion of the black paper which came into contact with the surface of the ink-receiving layer were measured by means of an optical reflection densitometer, 500 Spectral Densitometer (manufactured by X-Rite Co.). The film strength of the ink-receiving layer was calculated according to the following equation:

Film strength (%)=(OD of the black paper which came into contact with the surface of the ink-receiving layer)/(OD of the black paper which came into no contact with the surface of the ink-receiving layer)×100.

The evaluation criterion is as follows. Incidentally, the film strength of the ink-receiving layer of each of the respective recording media before the test was rank A.

A: The film strength was 80% or more;

B: The film strength was 65% or more to less than 80%;

B$^-$: The film strength was 55% or more to less than 65%;

C: The film strength was less than 55%.

TABLE 2

| | | Inorganic particle | | | | | Binder | | |
|---|---|---|---|---|---|---|---|---|---|
| | Coating Liquid | Inorganic Particle Dispersion Liquid | Oil absorption (ml/100 g) | BET specific surface area ($m^2/g$) | Proportion of pore volume (% by volume) | Kind | | Product (mass ratio) | Tg (° C.) |
| Ex. 1 | A | I | 220 | 600 | 14.9 | Polycarbonate-modified urethane | | B1 | −15 |
| Ex. 2 | B | I | 220 | 600 | 14.9 | Polyether-modified urethane | | B2 | −50 |
| Ex. 3 | C | I | 220 | 600 | 14.9 | Acrylic | | B3 | 4 |
| Ex. 4 | D | I | 220 | 600 | 14.9 | Acrylic | | B4 | 4 |
| Ex. 5 | E | I | 220 | 600 | 14.9 | Acrylic | | B4 | 4 |
| Ex. 6 | F | I | 220 | 600 | 14.9 | Acrylic | | B4 | 4 |
| Ex. 7 | G | I | 220 | 600 | 14.9 | Acrylic | | B4 | 4 |
| Ex. 8 | H | I | 220 | 600 | 14.9 | Acrylic | | B5 | 23 |
| Ex. 9 | I | I | 220 | 600 | 14.9 | Polyvinyl alcohol/acrylic | | B6/B4 (18/82) | —/4 |
| Ex. 10 | J | I | 220 | 600 | 14.9 | Polyvinyl alcohol/acrylic | | B6/B4 (24/76) | —/4 |
| Ex. 11 | K | I | 220 | 600 | 14.9 | Acrylic | | B4 | 4 |
| Ex. 12 | L | II | 120 | 45 | 79.6 | Acrylic | | B4 | 4 |
| Ex. 13 | M | III | 260 | 300 | 59.7 | Acrylic | | B4 | 4 |
| Ex. 14 | N | I | 220 | 600 | 14.9 | Acrylic | | B4 | 4 |
| Comp. Ex. 1 | O | II | 120 | 45 | 79.6 | Acrylic | | B4 | 4 |
| Comp. Ex. 2 | P | I | 220 | 600 | 14.9 | Polyvinyl alcohol | | B6 | — |
| Comp. Ex. 3 | Q | I | 220 | 600 | 14.9 | Polyvinyl alcohol/acrylic | | B6/B4 (34/66) | —/4 |
| Comp. Ex. 4 | R | I | 220 | 600 | 14.9 | Polycarbonate-modified urethane | | B1 | −15 |
| Comp. Ex. 5 | S | I | 220 | 600 | 14.9 | Polyester | | B7 | 19 |

| | Surfactant | | | Contact angle 60 sec. later (degrees) | | |
|---|---|---|---|---|---|---|
| | Kind | Product (mass ratio) | HLB | | Ink absorbency | Durability |
| Ex. 1 | Acetylene glycol | C1 | 9 | 71 | A | A |
| Ex. 2 | Acetylene glycol | C1 | 9 | 63 | A | A |
| Ex. 3 | Acetylene glycol | C1 | 9 | 63 | A | A |
| Ex. 4 | Acetylene glycol | C1 | 9 | 62 | A | A |
| Ex. 5 | Acetylene glycol | C2 | 4 | 61 | A | A |
| Ex. 6 | Acetylene glycol | C3 | 8 | 61 | A | A |
| Ex. 7 | Acetylene glycol | C4 | 13 | 77 | B− | A |
| Ex. 8 | Acetylene glycol | C3 | 8 | 65 | B | B− |
| Ex. 9 | Acetylene glycol | C3 | 8 | 48 | A | B |
| Ex. 10 | Acetylene glycol | C3 | 8 | 42 | A | B− |
| Ex. 11 | Acetylene glycol/silicone | C3/C5 (1.2/0.4) | 8/9 | 66 | B | A |
| Ex. 12 | Acetylene glycol | C3 | 8 | 69 | B− | A |
| Ex. 13 | Acetylene glycol | C3 | 8 | 51 | A | B− |
| Ex. 14 | Acetylene alcohol | C6 | 8 | 60 | A | A |
| Comp. Ex. 1 | — | — | — | 88 | C | A |
| Comp. Ex. 2 | Acetylene glycol | C3 | 8 | 14 | A | C |
| Comp. Ex. 3 | Acetylene glycol | C3 | 8 | 37 | A | C |
| Comp. Ex. 4 | Polyether-modified silicone | C5 | 9 | 79 | C | A |
| Comp. Ex. 5 | Acetylene glycol | C3 | 8 | 63 | B | C |

Examples 15 to 24

Recording media according to Examples 15 to 24 were produced in the same manner as in Example 1 except that a mildew proofing agent was further added into the coating liquid C shown in Table 2 as shown in Table 3. Incidentally, regarding each of the recording media thus obtained, the contact angle of water to a surface of the ink-receiving layer at 60 seconds after contact of the water with the surface of the ink-receiving layer was measured in the same manner as in Example 1. As a result, the same results as in the recording media produced without adding a mildew proofing agent were obtained even in all the recording media. In addition, the average particle size of each mildew proofing agent was measured by a laser diffraction/scanning type particle size distribution measuring apparatus (Model: LS 13 320) manufactured by BECKMAN COULTER CO.

Evaluation of Recording Media:

Regarding the recording media obtained in Examples 15 to 24, mildew resistance before outdoor display and mildew resistance after outdoor display were evaluated according to the following method. The evaluated results are shown in Table 3. Incidentally, in the following evaluation criterion, "0" to "3" were taken as favorable levels, and "4" and "5" were taken as unacceptable levels in the present invention.

Mildew Resistance Before Outdoor Display

The mildew resistance before outdoor display of each of the recording media according to Examples 15 to 24 was evaluated by "Methods of test for fungus resistance" conforming to JIS Z 2911 (2010) Annex A; Method A of test for plastic products. Incidentally, "Methods of test for fungus resistance" conforming to JIS Z 2911 (2010) Annex A; Method A of test for plastic products is Japanese Industrial Standard conforming to International Standard ISO 846 1997. The evaluation criterion is as follows:

0: The growth of mildew is not observed even either visually or under a microscope;

1: The growth of mildew is not observed visually, but clearly observed under a microscope;

2: The growth of mildew is observed visually, and the area of the growth portion is less than 25% of the whole area of the sample;

3: The growth of mildew is observed visually, and the area of the growth portion is 25% or more and less than 50% of the whole area of the sample;

4: The fungal thread well grows, and the area of the growth portion is 50% or more of the whole area of the sample;

5: The fungal thread intensely grows and covers the whole surface of the sample.

Mildew Resistance After Outdoor Display

Each of the recording media according to Examples 15 to was exposed for 200 hours by means of the outdoor accelerated weathering test method conforming to ISO 18930 to conduct a durability test. The same evaluation as in the mildew resistance before outdoor display was made except that the recording medium after the test was used as a measurement sample. In addition, the evaluation criterion is also the same as in the mildew resistance before outdoor display.

TABLE 3

| | Coating liquid after addition of mildewproofing agent | Coating liquid before addition of mildewproofing agent | Mildewproofing agent | | |
|---|---|---|---|---|---|
| | | | Kind | Product name | Manufacturer |
| Ex. 15 | a | C | Benzimidazole compound | Biocut-BM100F | Nippon Soda Co., Ltd. |
| Ex. 16 | b | C | Pyrithione compound | Zinc OMADIN ZOE | Lonza Japan Ltd. |
| Ex. 17 | c | C | Triazole compound | Kabinon 800 | Toagosei Co., Ltd |
| Ex. 18 | d | C | Pyridine compound | San-ai zol 200 | San-ai Oil Co., Ltd. |
| Ex. 19 | e | C | Benzthiazole compound | 2-Thiocyano-methyl thiobenzothiazole | Tokyo Chemical Industry Co., Ltd. |
| Ex. 20 | f | C | Thiabendazole compound | Thiabendazole | Tokyo Chemical Industry Co., Ltd. |
| Ex. 21 | g | C | Cyanobromine compound | San-ai bac T-38 | San-ai Oil Co., Ltd. |
| Ex. 22 | h | C | Carbamic acid compound | SK-IPBC | San-ai Oil Co., Ltd. |
| Ex. 23 | i | C | Imidazole compound | San-ai zol 100 | San-ai Oil Co., Ltd. |
| Ex. 24 | j | C | Aliphatic cationic compound | Marukacide BC-IXA | Osaka Kasei Co., Ltd. |

| | Mildewproofing agent | | | Evaluated result | |
|---|---|---|---|---|---|
| | Solubility in water (% by mass) | Average particle size (μm) | Content of mildewproofing agent in ink-receiving layer (% by mass) | Mildew resistance before outdoor display | Mildew resistance after outdoor display |
| Ex. 15 | 1% by mass or less | 11.3 | 0.1 | 1 | 2 |
| Ex. 16 | 1% by mass or less | 3.5 | 0.2 | 1 | 2 |
| Ex. 17 | 1% by mass or less | 0.9 | 0.3 | 1 | 2 |
| Ex. 18 | 1% by mass or less | 12.3 | 0.5 | 0 | 2 |
| Ex. 19 | 1% by mass or less | 8.9 | 0.5 | 0 | 2 |

TABLE 3-continued

| | | | | | |
|---|---|---|---|---|---|
| Ex. 20 | 1% by mass or less | 7.1 | 1 | 0 | 1 |
| Ex. 21 | 1% by mass or less | 16.9 | 1 | 0 | 2 |
| Ex. 22 | 1% by mass or less | 15.1 | 2 | 0 | 0 |
| Ex. 23 | 1% by mass or less | 8.7 | 3 | 0 | 0 |
| Ex. 24 | 100% by mass | — | 0.5 | 3 | 5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-072000, filed Mar. 31, 2016, which is hereby incorporated by reference herein in its entirety.

What is claimed is:

1. A recording medium comprising:

a substrate; and an ink-receiving layer, wherein the ink-receiving layer comprises an inorganic particle, a binder, and at least one surfactant, wherein the binder contains at least one resin selected from the group consisting of an acrylic resin, a polycarbonate-modified urethane resin, and a polyether-modified urethane resin, wherein the at least one surfactant comprises an acetylene-based surfactant, and wherein a contact angle of water to a surface of the ink-receiving layer at 60 seconds after contact of the water with the surface of the ink-receiving layer is 40 degrees or more to 80 degrees or less.

2. The recording medium according to claim 1, wherein an HLB value of the acetylene-based surfactant is 10 or less.

3. The recording medium according to claim 1, wherein glass transition points of the acrylic resin, the polycarbonate-modified urethane resin and the polyether-modified urethane resin are each 20° C. or less.

4. The recording medium according to claim 1, wherein the inorganic particle comprises wet-process silica.

5. The recording medium according to claim 1, wherein a total pore volume of pores having a pore radius of 7 nm or more to 20 nm or less in the ink-receiving layer is 25% by volume or less with respect to the total pore volume of all the pores having a pore radius of 20 nm or less in the ink-receiving layer.

6. The recording medium according to claim 1, wherein an oil absorption of the inorganic particle is 150 ml/100 g or more to 240 ml/100 g or less.

7. The recording medium according to claim 1, wherein a BET specific surface area of the inorganic particle is 380 $m^2/g$ or more.

8. The recording medium according to claim 1, wherein the ink-receiving layer further contains a mildewproofing agent.

9. The recording medium according to claim 8, wherein a solubility of the mildewproofing agent in water is 1% by mass or less.

10. The recording medium according to claim 8, wherein an average particle size of the mildewproofing agent is 0.1 μm or more to 20 μm or less.

11. The recording medium according to claim 8, wherein the mildewproofing agent is at least one compound selected from the group consisting of a triazole compound, a pyrithione compound, a pyridine compound, a benzimidazole compound, a benzthiazole compound, a cyanobromine compound, a carbamic acid compound, an imidazole compound and a thiabendazole compound.

12. The recording medium according to claim 8, wherein a content of the mildewproofing agent in the ink-receiving layer is 0.05% by mass or more to 3% by mass or less with respect to the whole mass of the ink-receiving layer.

13. The recording medium according to claim 1, wherein a content of the binder in the ink-receiving layer is 30 parts by mass or more to 100 parts by mass or less with respect to 100 parts by mass of the inorganic particle.

14. The recording medium according to claim 1, wherein a content of the binder in the ink-receiving layer is 50 parts by mass or more to 70 parts by mass or less with respect to 100 parts by mass of the inorganic particle.

15. The recording medium according to claim 1, wherein the ink-receiving layer (i) does not contain a water-soluble resin, or (ii) contains a water-soluble resin, and the content of the water-soluble resin in the ink-receiving layer is 0% by mass or more to 20% by mass or less with respect to 100 parts by mass of the binder.

16. The recording medium according to claim 1, wherein the ink-receiving layer (i) does not contain a water-soluble resin, or (ii) contains a water-soluble resin, and the content of the water-soluble resin in the ink-receiving layer is 0% by mass or more to 15% by mass or less with respect to 100 parts by mass of the binder.

17. The recording medium according to claim 1, wherein the substrate is a resin-coated substrate, plastic film, or cloth.

* * * * *